US010651594B1

(12) United States Patent
Tsai et al.

(10) Patent No.: US 10,651,594 B1
(45) Date of Patent: May 12, 2020

(54) DETACHABLE ROBOTIC SYSTEM

(71) Applicant: Quanta Computer Inc., Taoyuan (TW)

(72) Inventors: Sheng-An Tsai, Taoyuan (TW);
Lu-Lung Tsao, Taoyuan (TW);
Yu-Ching Tsai, Taoyuan (TW)

(73) Assignee: Quanta Computer Inc., Taoyuan (TW)

( * ) Notice: Subject to any disclaimer, the term of this patent is extended or adjusted under 35 U.S.C. 154(b) by 0 days.

(21) Appl. No.: 16/398,830

(22) Filed: Apr. 30, 2019

(30) Foreign Application Priority Data

Feb. 19, 2019 (TW) ..... 108105495 A

(51) Int. Cl.

| | |
|---|---|
| ***H01R 13/62*** | (2006.01) |
| ***H01R 13/627*** | (2006.01) |
| ***H01R 33/975*** | (2006.01) |
| ***A47L 11/40*** | (2006.01) |
| ***A47L 9/00*** | (2006.01) |
| ***A47L 11/24*** | (2006.01) |

(52) U.S. Cl.
CPC ..... *H01R 13/6273* (2013.01); *A47L 9/009* (2013.01); *A47L 11/24* (2013.01); *A47L 11/4005* (2013.01); *A47L 11/4066* (2013.01); *H01R 13/6205* (2013.01); *H01R 33/975* (2013.01); *A47L 2201/00* (2013.01)

(58) Field of Classification Search
CPC ..... H01R 23/7026; H05K 7/1053; H05K 7/1023; H05K 7/1084
See application file for complete search history.

(56) References Cited

U.S. PATENT DOCUMENTS

| | | | | |
|---|---|---|---|---|
| 4,931,020 | A * | 6/1990 | Matsuoka | H05K 7/1023 439/330 |
| 5,905,638 | A * | 5/1999 | MacDonald, Jr. | H01R 13/2414 174/117 A |
| 6,191,480 | B1 * | 2/2001 | Kastberg | H01L 23/4006 257/692 |
| 7,963,789 | B1 * | 6/2011 | French, Jr. | H05K 7/1053 439/331 |
| 8,759,965 | B2 * | 6/2014 | Rotay | H01L 23/562 257/685 |
| 9,887,144 | B2 * | 2/2018 | Lin | H01L 23/16 |

FOREIGN PATENT DOCUMENTS

| | | |
|---|---|---|
| CN | 202005711 | 10/2011 |
| CN | 108371518 | 8/2018 |
| TW | 201813572 | 9/2016 |

* cited by examiner

*Primary Examiner* — Phuong Chi Thi Nguyen

(57) ABSTRACT

A detachable robot system includes a mobile working machine and an intelligent device. The mobile working machine includes a transmission wheel device, a first fastening portion and a first conductive contact. The first fastening portion and the transmission wheel device are oppositely arranged on the first main body. The transmission wheel device loads and moves the first main body. The intelligent device is completely removable from the mobile working machine, and includes a second fastening portion and a second conductive contact. Thus, when the intelligent device is loaded on the mobile working machine, the intelligent device is fixedly coupled to the mobile working machine by the first fastening portion and the second fastening portion engaged with each other, so that the first conductive contact and the second conductive contact are aligned and connected to each other.

9 Claims, 12 Drawing Sheets

DETACHABLE ROBOTIC SYSTEM

RELATED APPLICATIONS

This application claims priority to Taiwan Application Serial Number 108105495, filed Feb. 19, 2019, which is herein incorporated by reference.

BACKGROUND

Field of Disclosure

The disclosure relates to a robotic system. More particularly, the disclosure relates to a detachable robotic system.

Description of Related Art

With the development of science technology, a vacuum sweeping machine provided in the industry not only can automatically move around and clean, but also can be additionally equipped with an functional device such as a camera or a speaker, so as to provide more functions for the vacuum sweeping machine.

However, since the current functional device still cannot be securely positioned on the vacuum sweeping machine effectively, the connection quality between the functional device and the vacuum sweeping machine will be worsen, or the risk of the functional device being fallen from the vacuum sweeping machine to disconnect the functional device from the vacuum sweeping machine will be increased when climbing over the obstacles.

SUMMARY

In one embodiment of the disclosure, a detachable robot system is provided, and includes a mobile working machine and an intelligent device. The mobile working machine includes a first main body, a transmission wheel device and a first connection module. The first connection module and the transmission wheel device are oppositely arranged on the first main body. The transmission wheel device is used to load and move the first main body, and the first connection module includes a first fastening portion and a first conductive contact. The intelligent device includes a second main body and a second connection module. The second main body is completely removable from the first main body. The second connection module is disposed on the second main body, and includes a second fastening portion and a second conductive contact. Thus, when the intelligent device is loaded on the mobile working machine, a bottom portion of the second main body is fixedly coupled to a top portion of the first main body by the first fastening portion and the second fastening portion engaged with each other, so that the first conductive contact and the second conductive contact are aligned and connected to each other.

According to one or more embodiments of the disclosure, in the detachable robot system, the intelligent device further includes a receiving recess formed on the bottom portion of the second main body. The second connection module further includes a floating base and a cushion module. The floating base is movably retained within the receiving recess. The second conductive contact and the second fastening portion are respectively disposed on the floating base, and the cushion module is disposed in the floating base, and connected to the floating base and the second main body.

According to one or more embodiments of the disclosure, in the detachable robot system, the floating base includes an outer rim portion and a protruding body, the outer rim portion is fixedly connected to one side of the protruding body, projects outwardly from the protruding body to surround the protruding body, the receiving recess is formed with an inner side surface and an adjoining surface, and the adjoining surface is adjoined to the inner side surface for interfering with the outer rim portion from moving outwards from the receiving recess. Thus, when the intelligent device is loaded on the mobile working machine, a vertical gap is formed between the adjoining surface and the outer rim portion, and a horizontal gap is formed between the inner side surface and the protruding body.

According to one or more embodiments of the disclosure, in the detachable robot system, the cushion module further includes a plurality of cushion springs. The cushion springs are symmetrically arranged on one surface of the floating base being opposite to the mobile working machine. The second conductive contact includes a spring connector. The resilient force of the spring connector is less than the resilient force of each of the cushion springs.

According to one or more embodiments of the disclosure, in the detachable robot system, the first fastening portion includes two position-limited slots. The first conductive contact is located between the position-limited slots. The second fastening portion includes two hooking portions, and the second conductive contact is located between the hooking portions, each of the hooking portions is pivotally connected to the second main body for being rotatably moved into and engaged within one of the position-limited slots.

According to one or more embodiments of the disclosure, in the detachable robot system, the second connecting module further includes two elastic members respectively located in the floating base. Each of the elastic members is connected to the floating base and one of the hooking portions, respectively.

According to one or more embodiments of the disclosure, in the detachable robot system, each of the hooking portions includes an L-shaped member, a pivot shaft and a hook body. The L-shaped member has a first rod body and a second rod body which are adjoined to each other. Each of the elastic members abuts against the second rod body and the floating base. The pivot shaft is disposed on a junction portion of the first rod body and the second rod body, and is used to pivot the L-shaped member to the floating base. The hook body is disposed on the first rod body of the L-shaped member so as to be removably hooked on one of the position-limited slots.

According to one or more embodiments of the disclosure, in the detachable robot system, the hook bodies are faced to each other or faced away from each other.

According to one or more embodiments of the disclosure, in the detachable robot system, the mobile working machine further includes a first magnetic body being embedded in the first main body. The intelligent device further includes a second magnetic body being embedded in the second main body to align with the first magnetic body. Thus, the first magnetic body and the second magnetic body are magnetically attracted to each other when the first fastening portion and the second fastening portion are engaged with each other.

In one embodiment of the disclosure, a detachable robot system is provided, and includes a mobile working machine and an intelligent device. The mobile working machine includes a first main body, a transmission wheel device, at least one position-limited slot and a first conductive contact. The position-limited slot and the first conductive contact are respectively disposed at a top portion of the first main body.

The transmission wheel device is arranged at a bottom portion of the first main body, and configured to load and move the first main body. The intelligent device includes a second main body, at least one hooking portion, a linkage member and a second conductive contact. The second main body is completely removable from the top portion of the first main body. The hooking portion is pivotally connected to the second main body. One end of the hooking portion is removably engaged with the position-limited slot. The linkage member is disposed in the second main body, and connected to the second main body and the other end of the hooking portion. The second conductive contact is disposed on a bottom portion of the second main body, and is removably connected to the first conductive contact. The linkage member includes a cushion spring. Thus, when the intelligent device is vertically ascended relative to the mobile working machine so that the second main body rotates the hooking portion to move away from the position-limited slot with the linkage member, the second main body is separated from the first main body, and the second conductive contact is separated from the first conductive contact.

Thus, through the construction of the embodiments above, the detachable robot system can be effectively loaded or unloaded the intelligent device from the mobile working machine under an unmanned automation environment. Thus, the problem of the conductive contacts failing to be properly positioned to cause signal instability due to misalignment can be avoided, and the risk of the intelligent device being fallen from the mobile working machine will be reduced when climbing over the obstacles.

The above description is merely used for illustrating the problems to be resolved, the technical methods for resolving the problems and their efficacies, etc. The specific details of the disclosure will be explained in the embodiments below and related drawings.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure. In the drawings.

DESCRIPTION OF THE EMBODIMENTS

Figure 1:
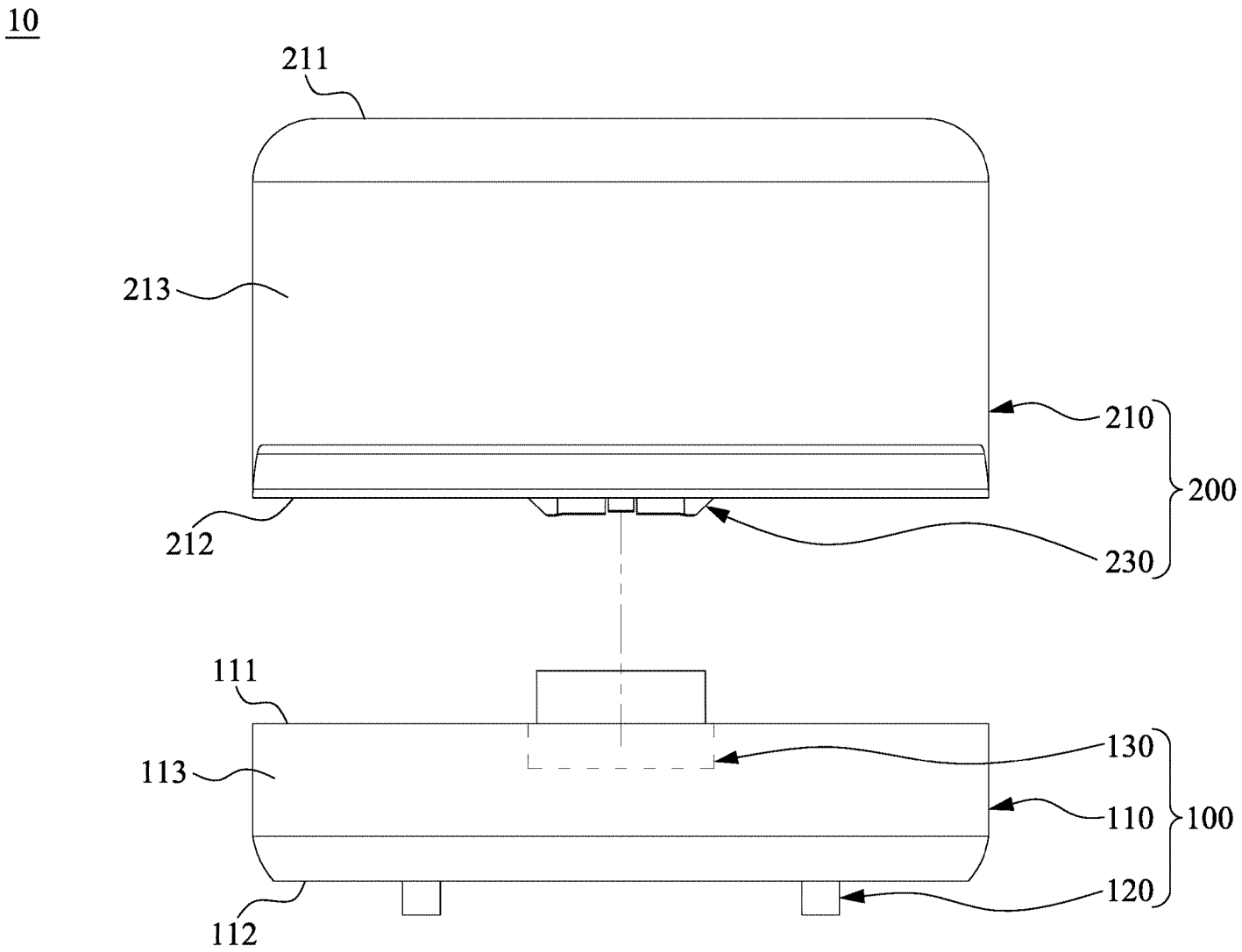
FIG. 1 is an exploded view of a detachable robot system according to one embodiment of the disclosure.

Reference will now be made in detail to the present embodiments of the disclosure, examples of which are illustrated in the accompanying drawings. Wherever possible, the same reference numbers are used in the drawings and the description to refer to the same or like parts. According to the embodiments, it will be apparent to those skilled in the art that various modifications and variations can be made to the structure of the disclosure without departing from the scope or spirit of the disclosure.

Figure 2:
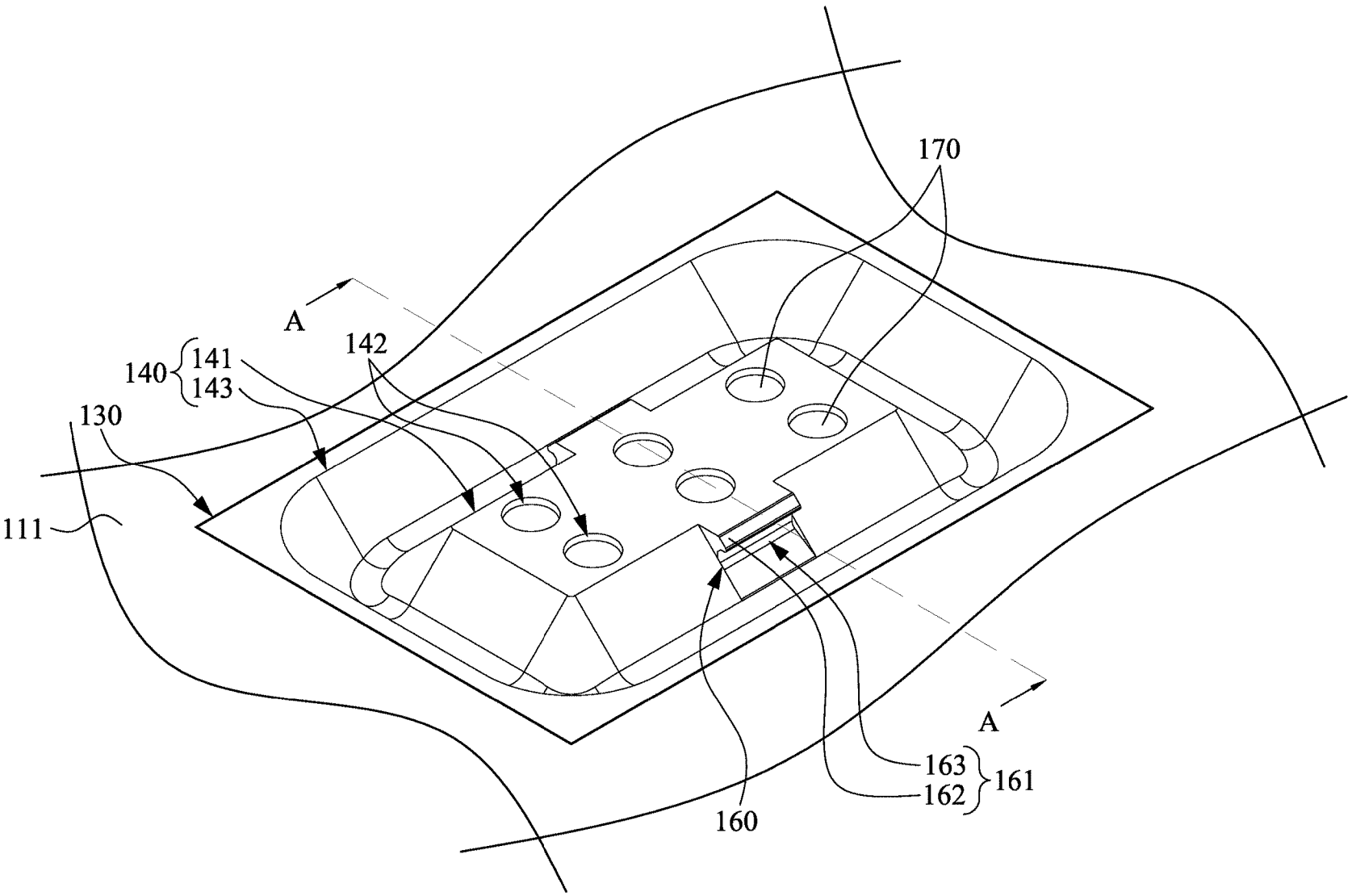
FIG. 2 is a partial schematic view of a mobile working machine of FIG. 1.
Figure 3:
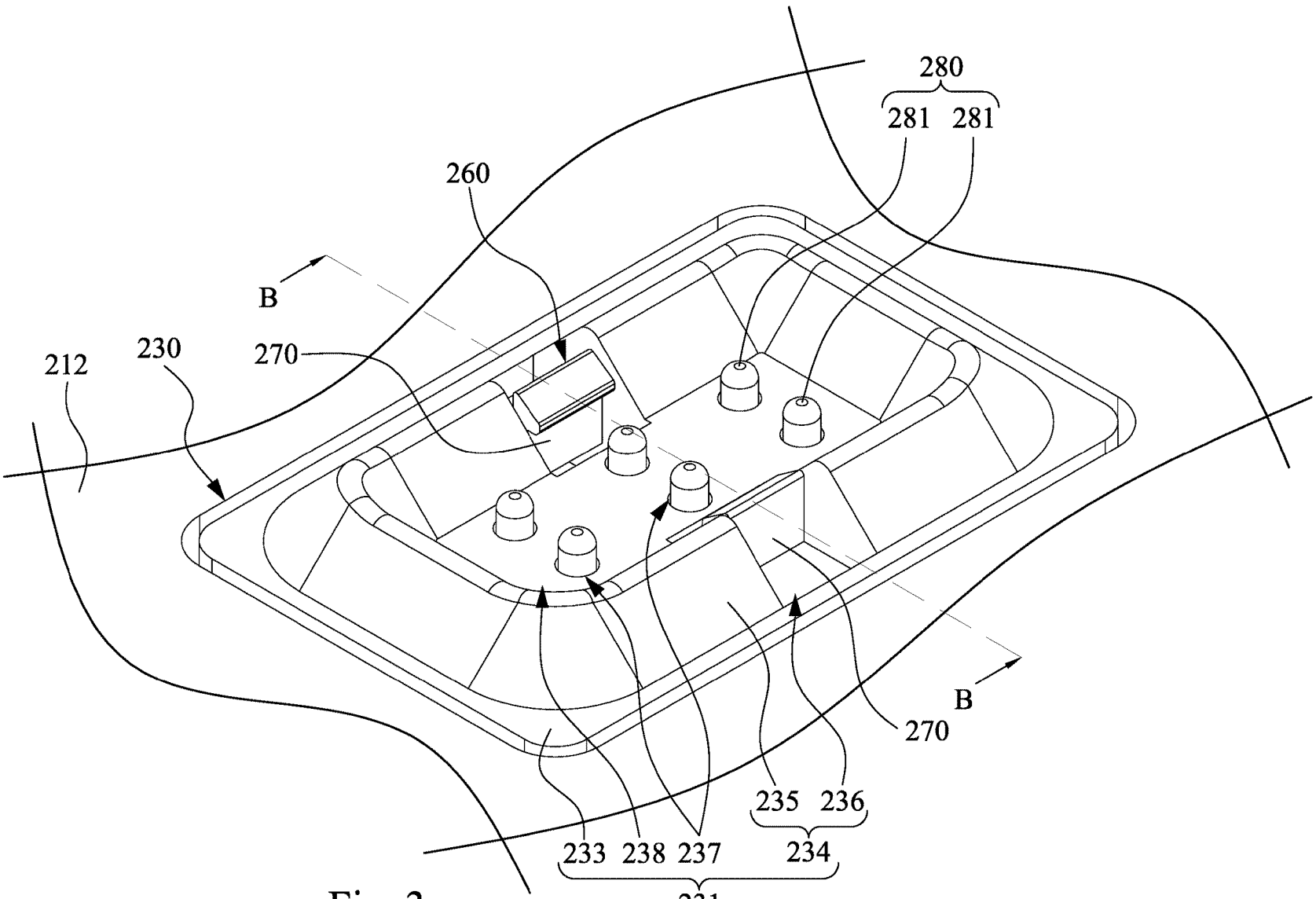
FIG. 3 is a partial schematic view of an intelligent device of FIG. 1.

Reference is now made to FIG. 1 to FIG. 3, in which FIG. 1 is an exploded view of a detachable robot system 10 according to one embodiment of the disclosure, FIG. 2 is a partial schematic view of a mobile working machine 100 of FIG. 1, and FIG. 3 is a partial schematic view of an intelligent device 200 of FIG. 1. As shown in FIG. 1 to FIG. 3, the detachable robot system 10 includes a mobile working machine 100 and an intelligent device 200. The mobile working machine 100 includes a first main body 110, a transmission wheel device 120 and a first connection module 130. The first connection module 130 and the transmission wheel device 120 are oppositely arranged on the first main body 110, and the first connection module 130 includes a first fastening portion 160 and a plurality of first conductive contacts 170. In the embodiment, the first main body 110 includes a first top portion 111, a first bottom portion 112 and a first outer lateral surface 113. The first top portion 111 and the first bottom portion 112 are opposite to each other, and the first outer lateral surface 113 surrounds the first top portion 111 and the first bottom portion 112, and adjoins the first top portion 111 and the first bottom portion 112, respectively. The transmission wheel device 120 is disposed on the first bottom portion 112 of the first main body 110, and used to load and move the first main body 110. The first connection module 130 is disposed on the first top portion 111 of the first main body 110. The first conductive contacts 170 are spaced arranged spaced on the first top portion 111 of the first main body 110 according to a predetermined arrangement. However, the disclosure is not limited thereto. In other embodiments, the first connection module 130 may also be located at other positions of the first main body 110.

The intelligent device 200 includes a second main body 210 and a second connection module 230. The second main body 210 is completely removable from the first main body 110. The second connection module 230 is disposed on the second main body 210, and is used to removably contact with the first connection module 130. The second connection module 230 includes a second fastening portion 260 and a plurality of second conductive contacts 280.

In the embodiment, the second main body 210 includes a second top portion 211, a second bottom portion 212 and a second outer lateral surface 213. The second top portion 211 and the second bottom portion 212 are opposite to each other, and the second outer lateral surface 213 surrounds the second top portion 211 and the second bottom portion 212, and adjoins the second top portion 211 and the second bottom portion 212, respectively. The second connection module 230 is disposed on the second bottom portion 212 of the second main body 210. In other embodiments, the second connection module 230 may also be located at other positions of the second main body 210.

Figure 4A:
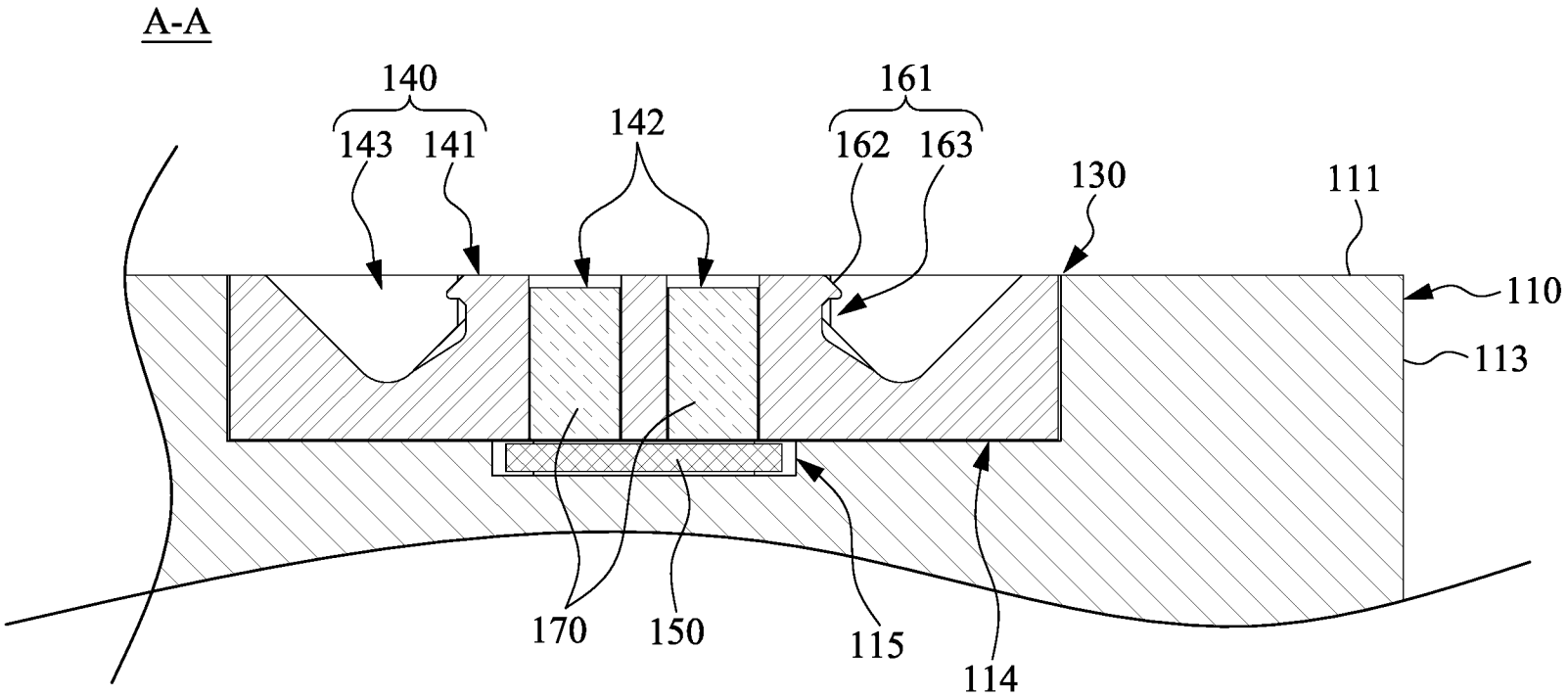
FIG. 4A is a partial cross-sectional view of the mobile working machine of FIG. 2 viewed along a line A-A.

FIG. 4A is a partial cross-sectional view of the mobile working machine 100 of FIG. 2 viewed along a line A-A. Specifically, as shown in FIG. 2 and FIG. 4A, in the embodiment, the first main body 110 further includes a first groove 114 and a second groove 115. The first groove 114 is concavely formed on the first top portion 111 of the first main body 110. The second groove 115 is formed on the groove bottom of the first groove 114, and the size of the second groove 115 is less than the size of the first groove 114. The first connection module 130 further includes a connecting seat 140 and a first circuit board 150. The first circuit board 150 is located within the second groove 115. The connecting seat 140 is located within the first groove 114 to cover the first circuit board 150 and the second groove 115.

The connecting seat 140 includes a projection portion 141 and a surrounding groove 143. The surrounding groove 143 is concavely formed on one surface of the connecting seat 140 being opposite to the first circuit board 150, and the surrounding groove 143 surrounds the projection portion 141. The projection portion 141 includes a plurality of first through holes 142. The first through holes 142 are spaced arranged on the projection portion 141 according to the predetermined arrangement mentioned above. The first conductive contacts 170 respectively, for example, are conductive posts, and embedded in the first through holes 142, respectively. One end of each of the first conductive contacts 170 is soldered to the first circuit board 150, and the other end is located within one of the first through holes 142 to be exposed outwards from the surface of the projection portion 141 being opposite to the first circuit board 150. The first fastening portion 160 includes two position-limited slots 161, and the position-limited slots 161 are respectively formed on two opposite sides of the projection portion 141 respectively facing towards the surrounding groove 143. The first conductive contacts 170 are located between the position-limited slots 161. In the embodiment, each of the position-limited slots 161 further includes a guiding portion 162 and a slot inlet 163. The guiding portion 162 is located above the slot inlet 163 to adjoin the slot inlet 163.

Figure 4B:
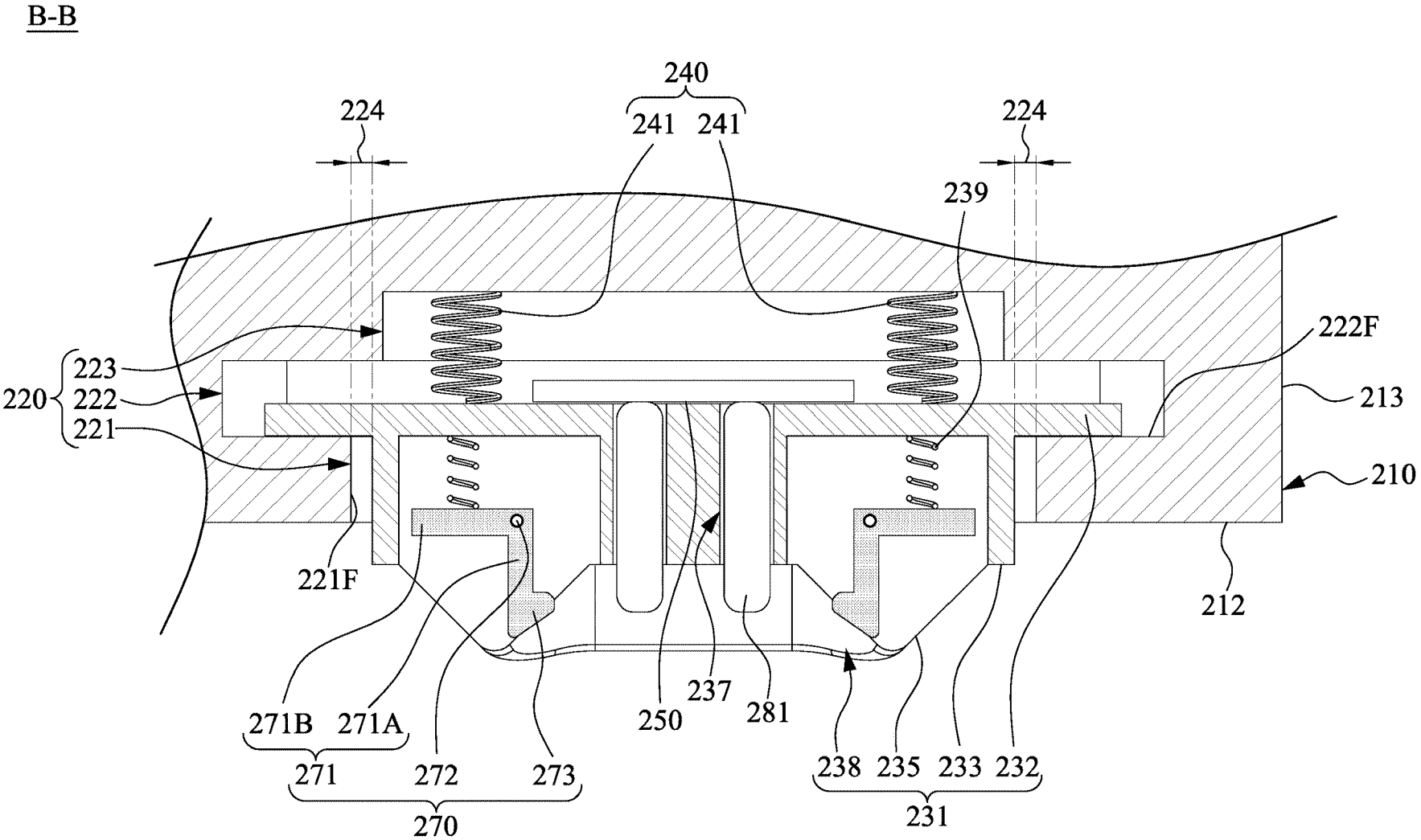
FIG. 4B is a partial cross-sectional view of the intelligent device of FIG. 3 viewed along a line B-B.

FIG. 4B is a partial cross-sectional view of the intelligent device 200 of FIG. 3 viewed along a line B-B. In the embodiment, as shown in FIG. 3 and FIG. 4B, specifically, the second main body 210 further includes a receiving recess 220 concavely formed on the second bottom portion 212 of the second main body 210. The second connection module 230 further includes a floating base 231, a cushion module 240 and a second circuit board 250. The floating base 231 is movably retained within the receiving recess 220, and the second fastening portion 260 and the second conductive contacts 280 are disposed on the floating base 231, respectively. The cushion module 240 is disposed in the receiving recess 220, and coupled to the floating base 231 and the second main body 210. The second circuit board 250 is disposed between the floating base 231 and the second main body 210 in the receiving recess 220, and fixedly disposed on one surface of the floating base 231 being opposite to the mobile working machine 100 so as to collectively move with the floating base 231.

More specifically, the receiving recess 220 includes a notch 221, a third groove 222 and a fourth groove 223. The notch 221 is concavely formed on the second bottom portion 212 of the second main body 210. The third groove 222 is formed between the notch 221 and the fourth groove 223. The size of the third groove 222 is greater than the size of the notch 221 and the size of the fourth groove 223. The fourth groove 223 is formed on a groove bottom of the third groove 222. The floating base 231 includes an outer rim portion 232 and a protruding body 233. The outer rim portion 232 is fixedly connected to one side of the protruding body 233, and the outer rim portion 232 projects outwardly from the protruding body 233 to surround the protruding body 233.

When the intelligent device 200 has not been loaded on the mobile working machine 100, the outer rim portion 232 is movably retained within the third groove 222. The protruding body 233 is located within the notch 221 such that an inner side surface 221F of the notch 221 surrounds the protruding body 233 so as to form a horizontal gap 224 between the inner side surface 221F of the notch 221 and the protruding body 233. The third groove 222 is formed with an adjoining surface 222F therein. The adjoining surface 222F adjoins the inner side surface 221F of the notch 221 to interfere with the outer rim portion 232 from moving outwards from the receiving recess 220.

The cushion module 240 further includes a plurality (e.g., four) of cushion springs 241. The cushion springs 241 are symmetrically arranged on one surface of the floating base 231 being opposite to the mobile working machine 100. Exemplarily, the cushion springs 241 are symmetrically arranged on one surface of the outer rim portion 232 being opposite to the mobile working machine 100. Thus, before the intelligent device 200 has been loaded on the mobile working machine 100, the cushion springs 241 enable the floating base 231 to be in a preloaded state, that is, the cushion springs 241 mutually provide a uniform force for pushing the floating base 231 towards the notch 221 so that the outer rim portion 232 of the floating base 231 is pushed to abut against the adjoining surface 222F of the third groove 222 without being randomly swayed.

The floating base 231 further includes an annular protrusion 234 and a plurality of second through holes 237. The annular protrusion 234 is formed on one surface of the protruding body 233 being opposite to the outer rim portion 232 to surround and define a sunken portion 238. Furthermore, one surface of the annular protrusion 234 being opposite to the sunken portion 238 is further formed with a guided slope 235. The second through holes 237 are spaced arranged in the sunken portion 238 according to the predetermined arrangement mentioned above. The second conductive contacts 280 respectively, for example, are conductive posts, and embedded in the second through holes 237, respectively. One end of each of the second conductive contacts 280 is soldered to the second circuit board 250, and the other end is projected into the sunken portion 238 from one of the second through holes 237. The second fastening portion 260 includes two hooking portions 270. The hooking portions 270 are respectively formed on the annular protrusion 234, for example, the hooking portions 270 are respectively disposed in two trenches 236 which are arranged oppositely on the annular protrusion 234. The second conductive contacts 280 are located between the hooking portions 270. Each of the hooking portions 270 is pivotally connected to the second main body 210, that is, each of the hooking portions 270 is rotatably disposed in one of the trenches 236 for being engaged with one of the position-limited slots 161. For example, each of the second conductive contacts 280 includes a spring connector 128 (e.g., Pogo Pin). Each of the spring connector 281 can be compressed to be shortened in length, and will be restored to the original long form by its resilience when it is no longer compressed. The resilient force of the spring connector 281 is less than the resilient force of each of the cushion springs 241.

In addition, in the embodiment, the second connection module 230 further includes two elastic members 239 respectively located in the floating base 231. Each of the elastic members 239 is connected to the floating base 231 and one of the hooking portions 270, respectively, that is, each of the elastic members 239 is disposed within one of the trenches 236 and abuts against the bottom of one of the trenches 236 and one of the hooking portions 270, respectively. For example, each of the elastic members 239 is, for example, a compression spring or the like.

For example, more particularly, each of the hooking portions 270 includes an L-shaped member 271, a pivot shaft 272 and a hook body 273. The L-shaped member 271 has a first rod body 271A and a second rod body 271B which are adjoined to each other. The long axis direction of the first rod body 271A intersects the long axis direction of the second rod body 271B. Each of the elastic members 239 abuts against the second rod body 271B and the floating base 231. The pivot shaft 272 is disposed on a junction portion of the first rod body 271A and the second rod body 271B, and is used to pivot the L-shaped member 271 to the floating base 231. The hook body 273 is disposed on the first rod body 271A of the L-shaped member 271 so as to be removably hooked on one of the position-limited slots 161. The hook bodies 273 of the hooking portions 270 are faced to each other.

Figure 5A:
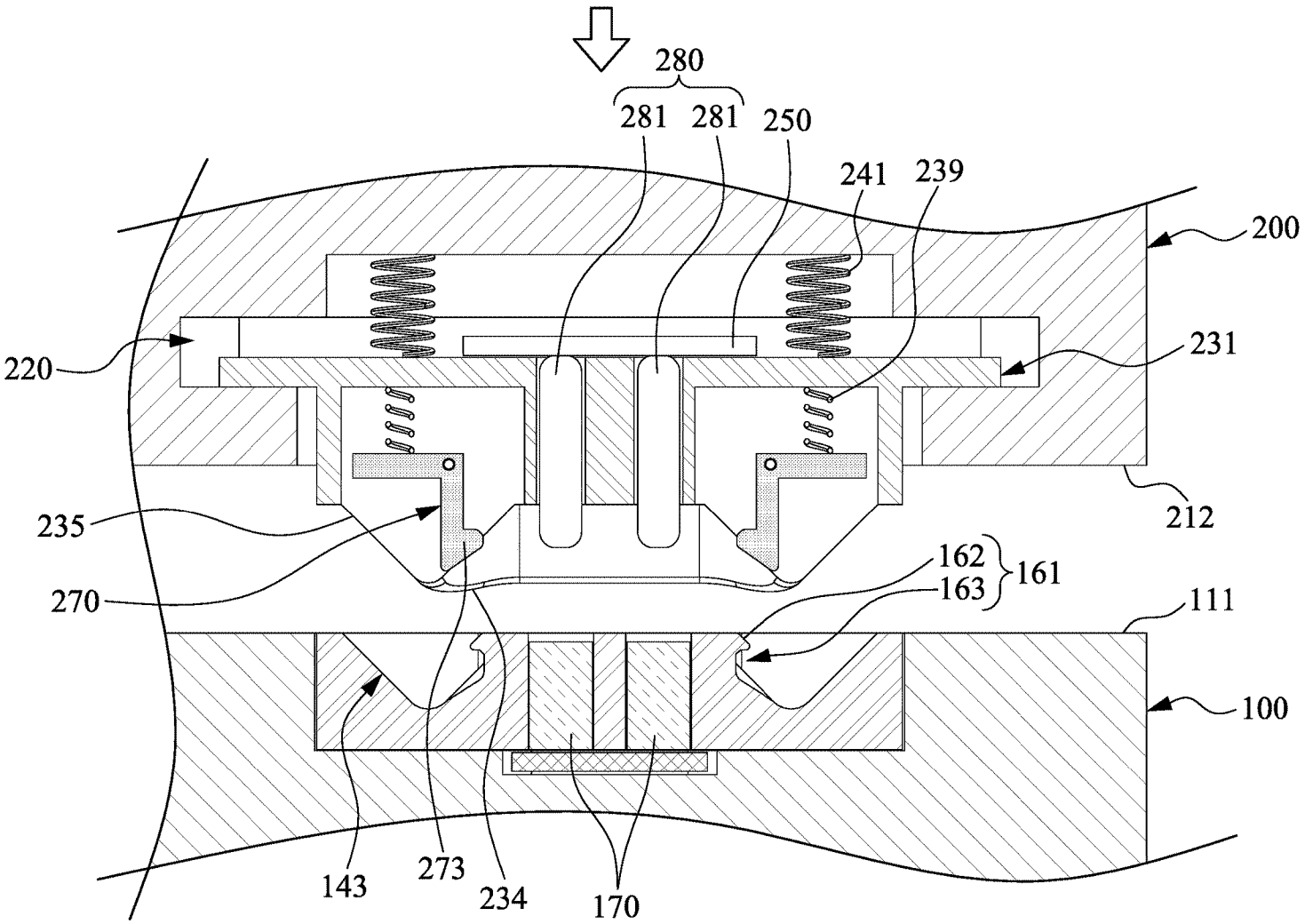
FIG. 5A-FIG. 5D are continuous schematic views expressing the intelligent device being loaded on the mobile working machine.
Figure 5B:
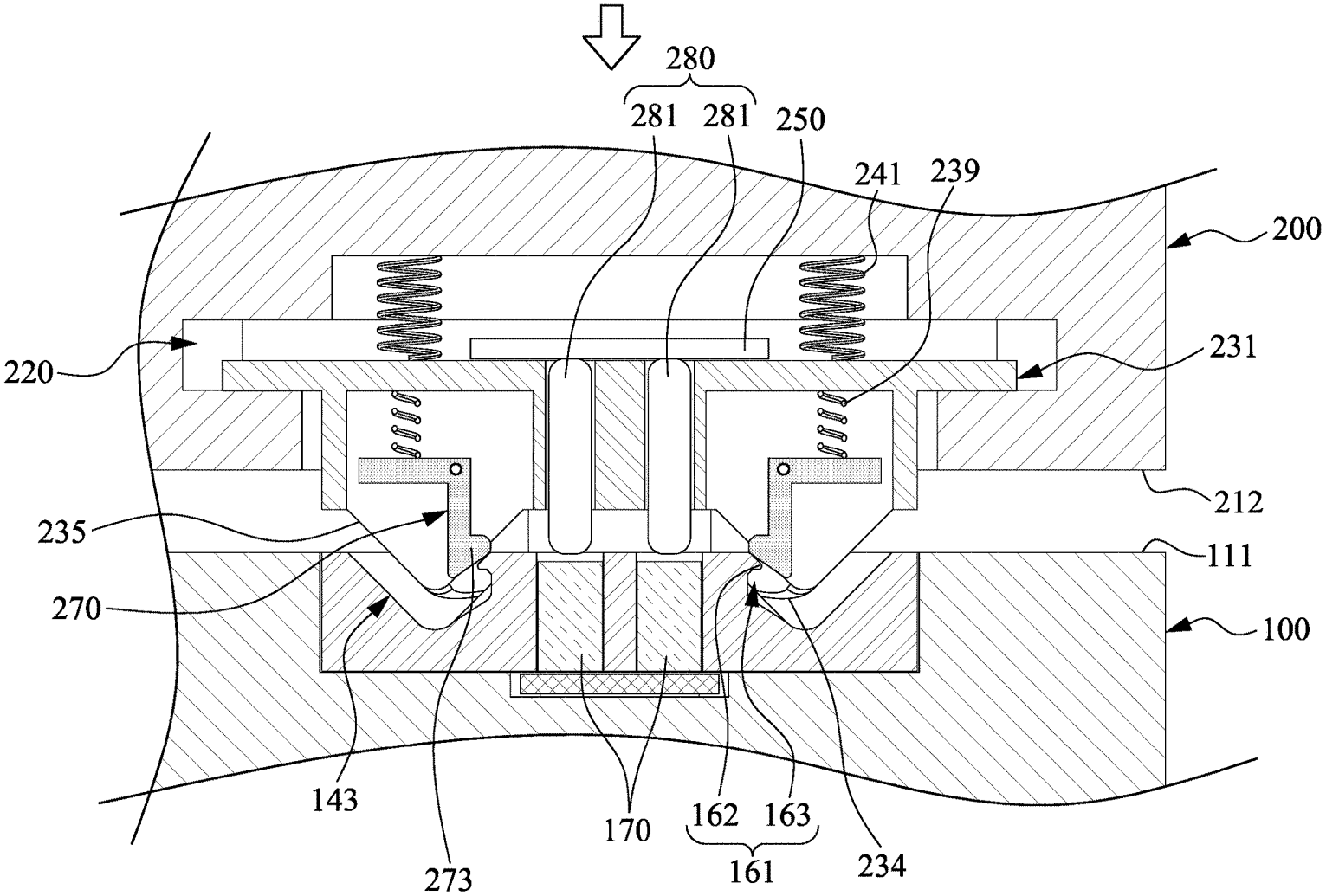
Figure 5C:
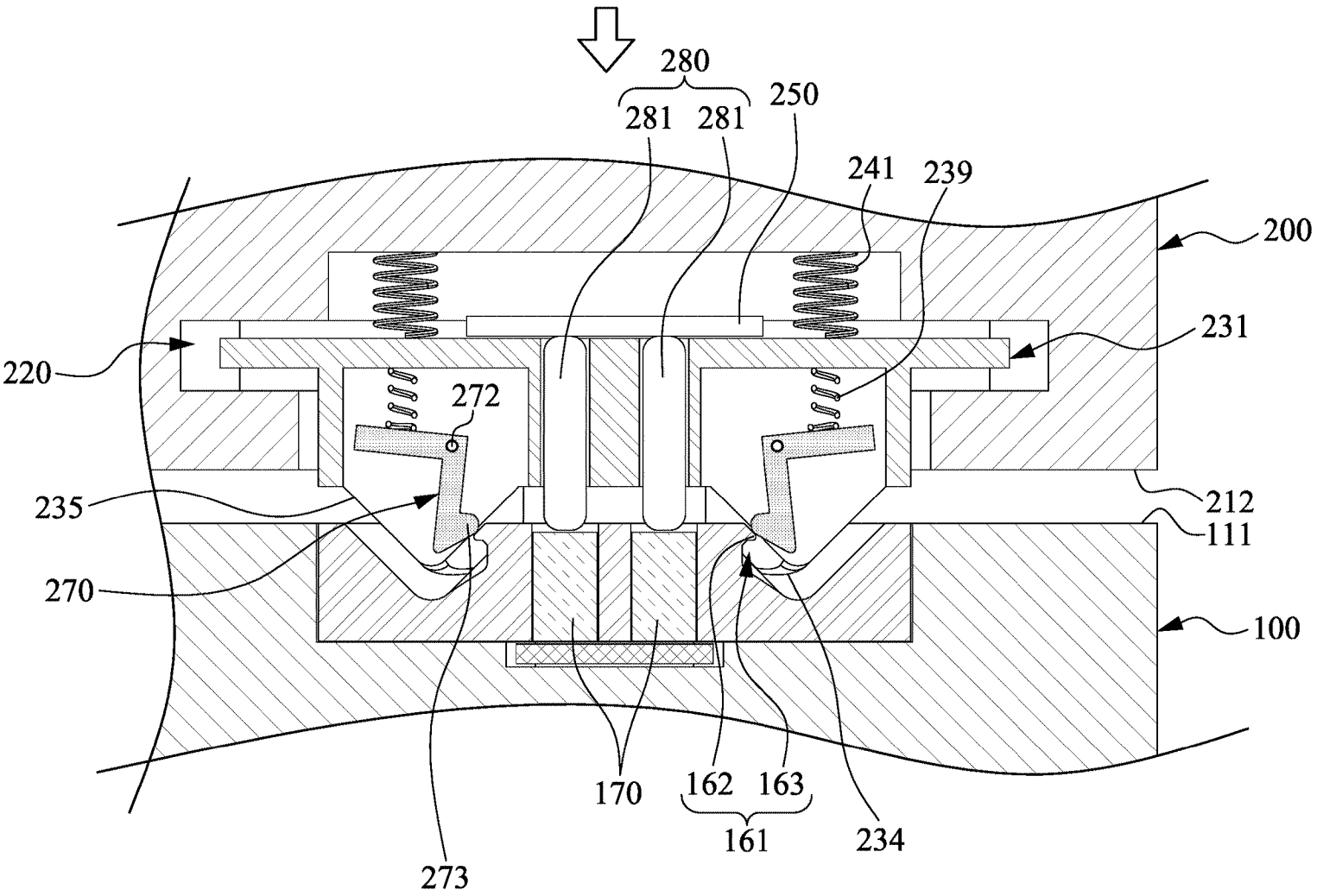
Figure 5D:
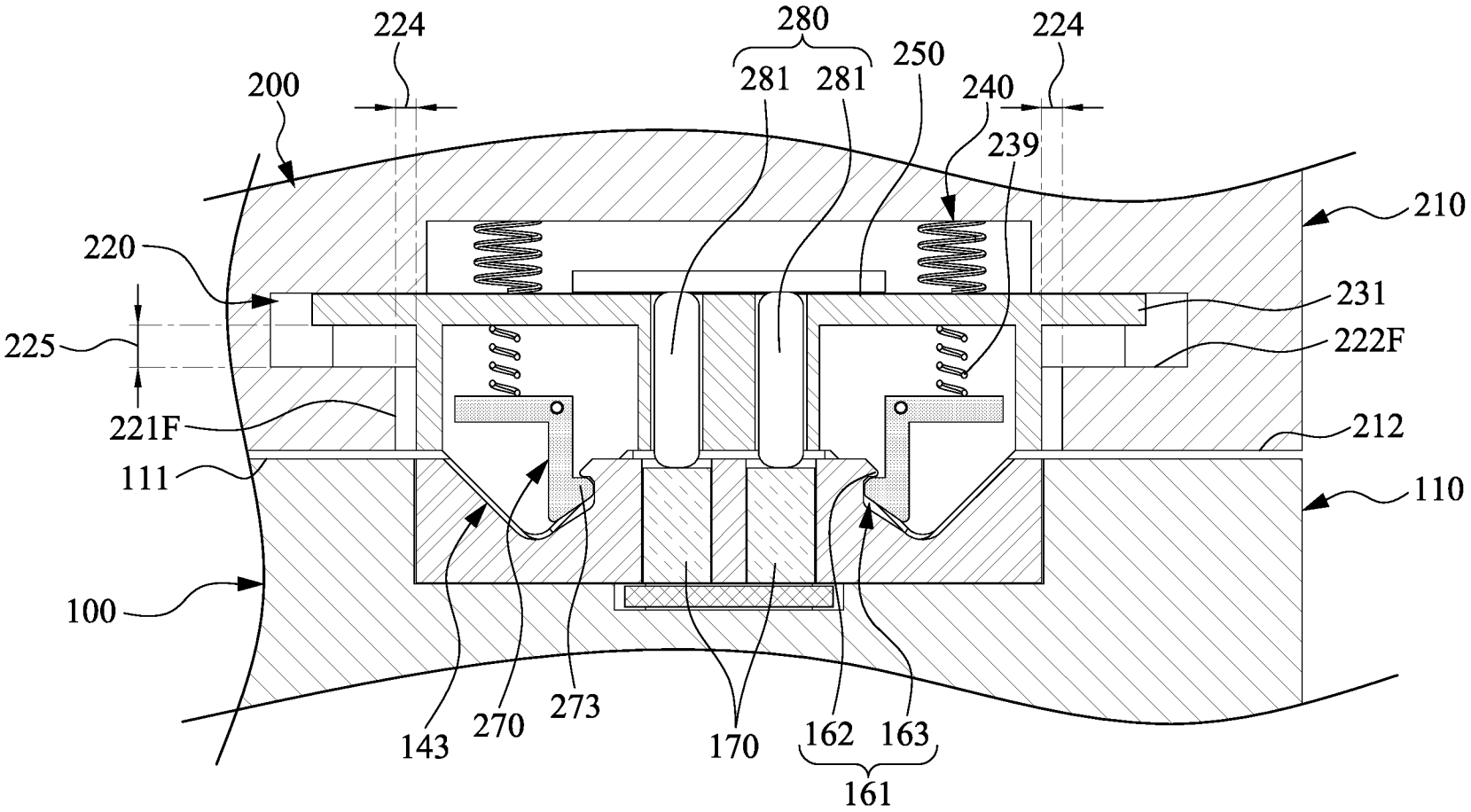

FIG. 5A-FIG. 5D are continuous schematic views expressing the intelligent device 200 being loaded on the mobile working machine 100. As shown in FIG. 5A and FIG. 5B, when the intelligent device 200 of FIG. 5A is desired to be loaded onto the mobile working machine 100, the intelligent device 200 is first descended vertically to the first top portion 111 of the mobile working machine 100. Next, through the guiding of the guiding slope 235, the annular protrusion 234 of the intelligent device 200 starts to insert into the surrounding groove 143 of the mobile working machine 100, and the hook body 273 of each of the hooking portions 270 starts to contact with the guiding portions 162 of each of the position-limited slots 161. (FIG. 5B). Next, when the intelligent device 200 continues to push the mobile working machine 100, the guiding portions 162 of the position-limited slots 161 pushes the corresponding hooking portion 270, so that the hooking portion 270 starts to rotate about the pivot shaft 272 (FIG. 5C), and the hooking portion 270 starts to compress the corresponding elastic member 239. At this moment, As shown in FIG. 5C, the first conductive contacts 170 respectively contact with the second conductive contacts 280. Since the horizontal gap 224 is formed between the inner side surface 221F of the notch 221 and the protruding body 233. In this embodiment, since the horizontal gap 224 described above is formed between the receiving recess 220 and the floating base 231, the floating base 231 can horizontally correct the dislocation between the first conductive contact 170 and the second conductive contact 280 in the horizontal direction. Next, when the hook body 273 of each of the hooking portions 270 starts to reach the slot inlet 163 of the corresponding position-limited slot 161 from the guiding portion 162, the resilient force of the corresponding elastic member 239 rotates the hook body 273 of the corresponding hooking portion 270 into the slot inlet 163 to be engaged with one of the position-limited slots 161. Thus, the second bottom portion 212 of the second main body 210 is fixedly coupled to the first top portion 111 of the first main body 110. In this moment, as shown in FIG. 5D, the first conductive contacts 170 are respectively compressed by the second conductive contacts 280 to be tightly contacted with the second conductive contacts 280. Thus, since the cushion module 240 causes the second conductive contacts 280 to continuously press the first conductive contacts 170 downwardly, the bonding force of the intelligent device 200 to the mobile working machine 100 further allows the second conductive contact 280 to firmly press the first conductive contacts 170.

It is noted, since the arrangement positions of the first conductive contacts 170 and the second conductive contacts 280 are designed in correspondence to the first fastening portion 160 (FIG. 2) and the second fastening portion 260 (FIG. 3), thus, once the first fastening portion 160 and the second fastening portion 260 are mutually engaged with each other, the first conductive contacts 170 can be effectively aligned with and connected to the second conductive contacts 280.

In addition, as shown in FIG. 5D, after the intelligent device 200 is loaded on the mobile working machine 100, a vertical gap 225 is formed between the adjoining surface 222F of the third groove 222 and the outer rim portion 232 of the floating base 231. Since the horizontal gap 224 and the vertical gap 225 are disposed between the receiving recess 220 and the floating base 231, the cushion module 240 can absorb the vibration generated by the mobile working machine 100 during traveling, so as to reduce the risk of the intelligent device 200 falling from the mobile working machine 100.

Figure 6:
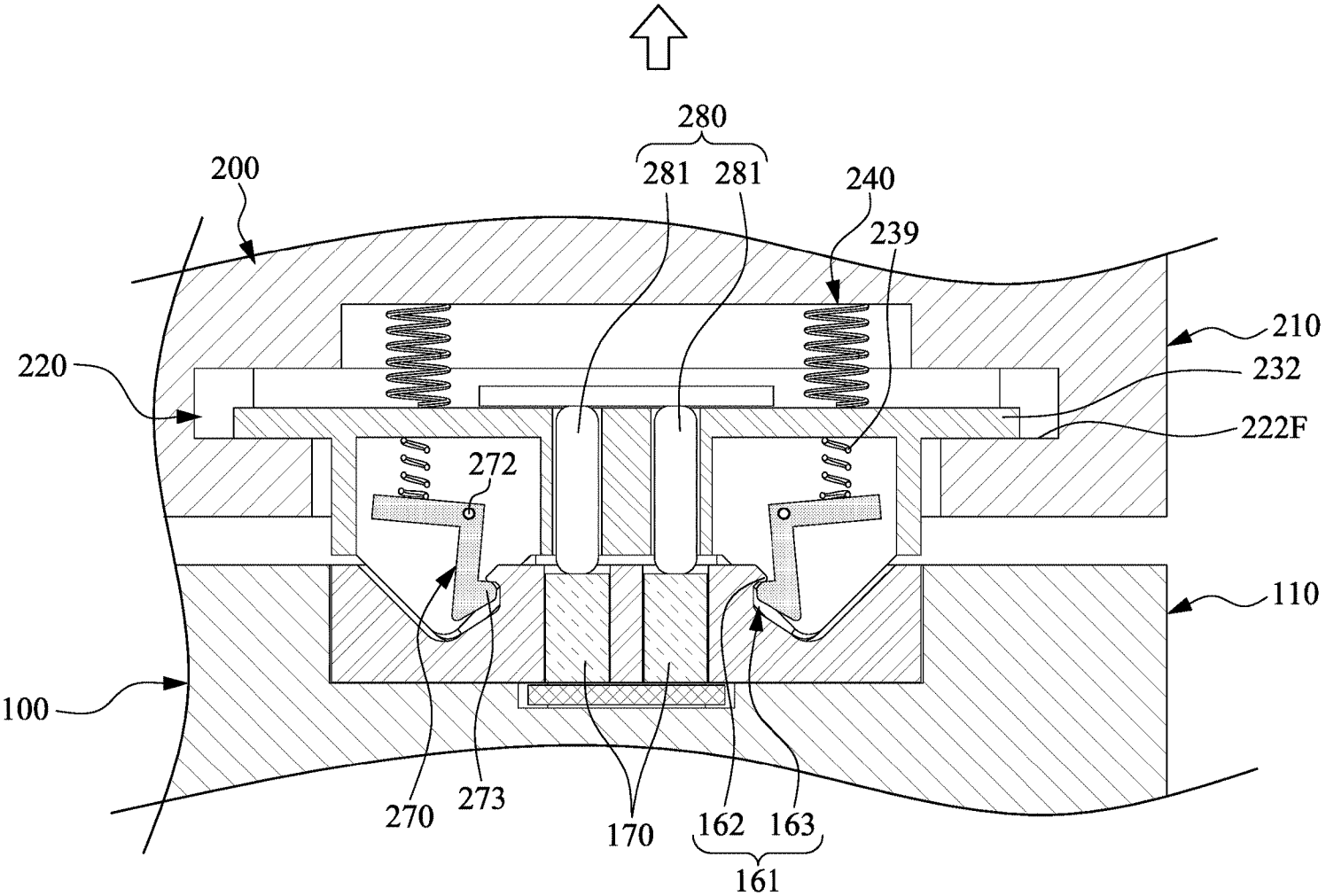
FIG. 6 is a schematic view of the intelligent device of FIG. 1 being removed from the mobile working machine.

On the other hand, FIG. 6 is a schematic view of the intelligent device 200 of FIG. 1 being removed from the mobile working machine 100. As shown in FIG. 5D to FIG. 6, when the intelligent device 200 of FIG. 5D is desired to be detached from the mobile working machine 100, the intelligent device 200 is first vertically ascended relative to the mobile working machine 100 so that the adjoining surface 222F of the receiving recess 220 of the second main surface is ascended to the outer rim portion 232 of the floating base 231, thereby pulling the floating base 231 upwardly; at this moment, the floating base 231 pulls the hooking portions 270 with the elastic members 239 as linkage members. Thus, since the hook bodies 273 are respectively blocked by the position-limited slots 161, each of the hooking portions 270 starts to rotate about the pivot shaft 272 (FIG. 6) until each of the hooking portions 270 completely disengages from the position-limited slots 161 (FIG. 5C). Thus, when the second main body 210 is separated from the first main body 110, the second conductive contacts 280 are separated from the first conductive contacts 170 (FIG. 5A).

Figure 7:
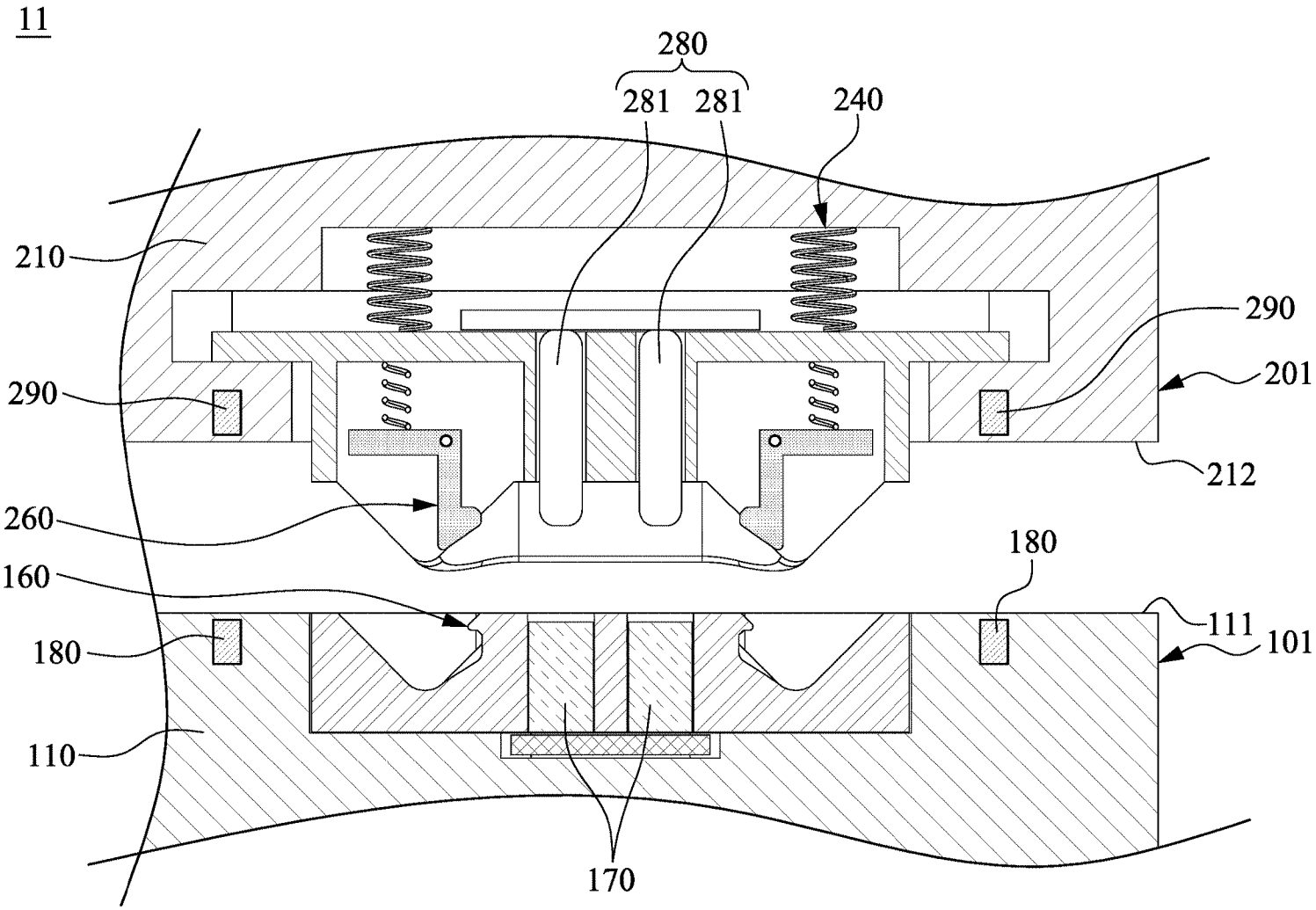
FIG. 7 is a partial cross-sectional view of the intelligent device being removed from the mobile working machine of the detachable robot system according to one embodiment of the disclosure.

FIG. 7 is a partial cross-sectional view of the intelligent device 201 being removed from the mobile working machine 101 of the detachable robot system 11 according to one embodiment of the disclosure. As shown in FIG. 7, in the embodiment, the detachable robot system 11 of FIG. 7 and the detachable robot system 10 of FIG. 1 are substantially the same, however, at least some differences of the detachable robot system 11 of FIG. 7 from that in FIG. 1 are that, the mobile working machine 101 further includes at least one first magnetic body 180. The first magnetic body 180 is completely buried inside the first main body 110. For example, the first magnetic body 180 is embedded in the internal of the material body of the first main body 110 and is adjacent to the surface of the first top portion 111 of the first main body 110, but is not exposed from the surface of the first top portion 111 of the first main body 110. The intelligent device 200 further includes at least one second magnetic body 290. The second magnetic body 290 is completely buried inside the second main body 210, and aligned with the first magnetic body 180. For example, the second magnetic body 290 is embedded in the internal of the material body of the second main body 210 and is adjacent to the surface of the second bottom portion 212 of the second main body 210, but is not exposed from the surface of the second bottom portion 212 of the second main body 210. When the first fastening portion 160 and the second fastening portion 260 are engaged with each other, with the first magnetic body 180 and the second magnetic body 290 are magnetically attracted to each other, the second bottom portion 212 of the second main body 210 can be more tightly coupled to the first top portion 111 of the first main body 110.

Figure 8:
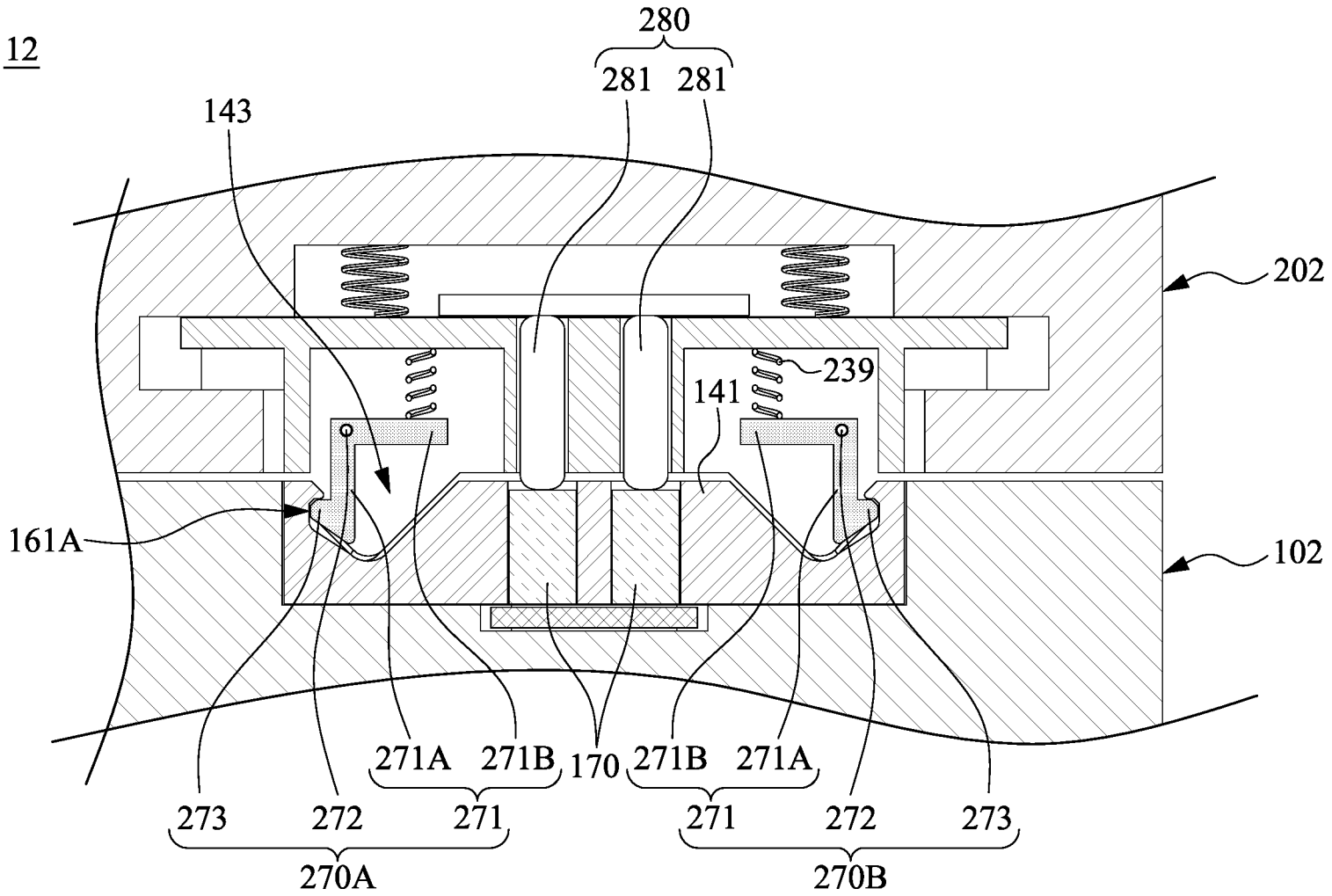
FIG. 8 is a partial cross-sectional view of the intelligent device being loaded on the mobile working machine of the detachable robot system according to one embodiment of the disclosure.

FIG. 8 is a partial cross-sectional view of the intelligent device 202 being loaded on the mobile working machine 102 of the detachable robot system 12 according to one embodiment of the disclosure. As shown in FIG. 8, in the embodiment, the detachable robot system 12 of FIG. 8 and the detachable robot system 10 of FIG. 1 are substantially the same, however, at least some differences of the detachable robot system 12 of FIG. 7 from that in FIG. 1 are that, the hooking portions 270A and 270B are symmetrically arranged with each other, and the hook bodies 273 of the hooking portions 270A and 270B are faced away from each other, that is, the hook bodies 273 of the two hooking portions 270A and 270B respectively extend towards away with each other. More specifically, the first rod body 271A of the hooking portion 270A is farther away from the first rod body 271A of the other hooking portion 270B than the second rod body 271B of the hooking portion 270A. The first rod body 271A of the hooking portion 270A is farther away from the second conductive contacts 280 than the corresponding elastic member 239. The two position-limited slots 161A are oppositely formed on opposite sides of the surrounding groove 143, and the opposite sides of the surrounding groove 143 respectively face the projection portion 141 with each other.

In each of the aforementioned embodiments, the mobile working machine 100 is a vacuum sweeping machine, and the dust sweeping machine has a dust suction opening (not shown in figures). The dust suction opening is located at the first bottom portion of the first main body 110. However, the disclosure is not limited to the type of mobile working machine. For example, in other embodiments, the mobile working machine may also be a mopping machine, a security patrol machine. In addition, the aforementioned intelligent device is not limited to a smart home device, a multimedia player, a security monitoring device, a smart secretary device or an air cleaner.

Although the disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A detachable robot system, comprising: a mobile working machine comprising a first main body, a transmission wheel device and a first connection module in which the first connection module and the transmission wheel device are oppositely arranged on the first main body, the transmission wheel device is configured to load and move the first main body, and the first connection module comprises a first fastening portion and a first conductive contact, and the first fastening portion comprises two position-limited slots; and an intelligent device comprising a second main body and a second connection module in which the second main body is completely removable from the first main body, the second connection module is disposed on the second main body, and comprising a second fastening portion, two elastic members and a second conductive contact, the second fastening portion comprises two hooking portions, each of the two hooking portions is pivotally connected to the second main body for being rotatably moved into and engaged within one of the two position-limited slots, and each of the two hooking portions comprises an L-shaped member having a first rod body and a second rod body which are adjoined to each other, and each of the two elastic members abuts against the second rod body and the second connection module; a pivot shaft disposed on a junction portion of the first rod body and the second rod body, for pivoting the L-shaped member to the second connection module; and a hook body disposed on the first rod body of the L-shaped member so as to be removably hooked on one of the two position-limited slots, wherein, when the intelligent device is loaded on the mobile working machine, a bottom portion of the second main body is fixedly coupled to a top portion of the first main body by the first fastening portion and the second fastening portion engaged with each other, so that the first conductive contact and the second conductive contact are aligned and connected to each other.

2. The detachable robot system of claim 1, wherein the hook bodies are faced to each other or faced away from each other.

3. The detachable robot system of claim 1, wherein the mobile working machine further comprises a first magnetic body being embedded in the first main body; and the intelligent device further comprises a second magnetic body being embedded in the second main body to align with the first magnetic body, wherein, the first magnetic body and the second magnetic body are magnetically attracted to each other when the first fastening portion and the second fastening portion are engaged with each other.

4. The detachable robot system of claim 1, wherein the intelligent device further comprising a receiving recess formed on the bottom portion of the second main body; and the second connection module further comprises a floating base and a cushion module, the floating base is movably retained within the receiving recess, wherein the second conductive contact and the second fastening portion are respectively disposed on the floating base, and the cushion module is disposed in the floating base, and connected to the floating base and the second main body.

5. The detachable robot system of claim 4, wherein the floating base comprises an outer rim portion and a protruding body, the outer rim portion is fixedly connected to one side of the protruding body, projects outwardly from the protruding body to surround the protruding body, the receiving recess is formed with an inner side surface and an adjoining surface, and the adjoining surface is adjoined to the inner side surface for interfering with the outer rim portion from moving outwards from the receiving recess, wherein, when the intelligent device is loaded on the mobile working machine, a vertical gap is formed between the adjoining surface and the outer rim portion, and a horizontal gap is formed between the inner side surface and the protruding body.

6. The detachable robot system of claim 4, wherein the cushion module further comprises a plurality of cushion springs, and the cushion springs are symmetrically arranged on one surface of the floating base being opposite to the mobile working machine, wherein the second conductive contact comprises a spring connector, and a resilient force of the spring connector is less than a resilient force of each of the cushion springs.

7. The detachable robot system of claim 4, wherein the first conductive contact is located between the two position-limited slots; and the second conductive contact is located between the two hooking portions.

8. The detachable robot system of claim 7, wherein the two elastic members respectively located in the floating base, and each of the two elastic members is connected to the floating base and one of the two hooking portions, respectively.

9. A detachable robot system, comprising:

a mobile working machine comprising a first main body, a transmission wheel device, at least one position-limited slot and a first conductive contact in which the at least one position-limited slot and the first conductive contact are respectively disposed at a top portion of the first main body, and the transmission wheel device is arranged at a bottom portion of the first main body, and configured to load and move the first main body; and an intelligent device comprising a second main body, at least one hooking portion, a linkage member and a second conductive contact in which the second main body is completely removable from the top portion of the first main body, the at least one hooking portion is pivotally connected to the second main body, one end of the at least one hooking portion is removably engaged with the at least one position-limited slot, the linkage member is disposed in the second main body, and connected to the second main body and the other end of the at least one hooking portion, the second conductive contact is disposed on a bottom portion of the second main body, and is removably connected to the first conductive contact, and the linkage member comprises a cushion spring, wherein, when the intelligent device is vertically ascended relative to the mobile working so that the second main body rotates the at least one hooking portion to move away from the at least one position-limited slot with the linkage member, the second main body is separated from the first main body, and the second conductive contact is separated from the first conductive contact.

* * * * *